US008337694B1

(12) United States Patent
Sykes et al.

(10) Patent No.: US 8,337,694 B1
(45) Date of Patent: Dec. 25, 2012

(54) DRAIN SCREEN ASSEMBLY

(76) Inventors: Tyrone W. Sykes, Upper Marlboro, MD (US); William A. Sykes, Upper Marlboro, MD (US)

( * ) Notice: Subject to any disclaimer, the term of this patent is extended or adjusted under 35 U.S.C. 154(b) by 308 days.

(21) Appl. No.: 12/788,180

(22) Filed: May 26, 2010

(51) Int. Cl.
*E03F 5/06* (2006.01)

(52) U.S. Cl. ..... 210/163; 210/170.03; 210/474; 210/483; 52/180; 52/182

(58) Field of Classification Search ..... 210/162, 210/163, 164, 470, 473, 474, 483, 170.01, 210/170.03; 52/180, 182
See application file for complete search history.

(56) References Cited

U.S. PATENT DOCUMENTS

| | | | | |
|---|---|---|---|---|
| 1,290,470 | A * | 1/1919 | Yordy | 210/474 |
| 1,483,095 | A * | 2/1924 | Kain | 52/182 |
| 2,701,027 | A * | 2/1955 | Scoville | 210/163 |
| 3,788,485 | A * | 1/1974 | Bruning | 210/474 |
| 4,301,557 | A | 11/1981 | Walraven | |
| 4,367,142 | A | 1/1983 | Blecher | |
| 4,658,449 | A * | 4/1987 | Martin | 210/163 |
| 5,130,016 | A | 7/1992 | Gavin | |
| 5,232,587 | A * | 8/1993 | Hegemier et al. | 210/162 |
| 5,405,539 | A * | 4/1995 | Schneider | 210/163 |
| 5,744,048 | A | 4/1998 | Stetler | |
| D397,457 | S | 8/1998 | Hutchings | |
| D422,061 | S | 3/2000 | Lee | |
| 7,066,111 | B2 | 6/2006 | McGregor | |
| 7,144,185 | B2 * | 12/2006 | Messerschmidt et al. | 210/164 |
| 7,504,024 | B1 * | 3/2009 | Batten et al. | 210/474 |
| 2003/0217955 | A1 * | 11/2003 | Strawser, Sr. | 210/163 |
| 2010/0187169 | A1 * | 7/2010 | Hilton et al. | 210/163 |

* cited by examiner

*Primary Examiner* — Christopher Upton

(57) ABSTRACT

A drain screen assembly for protecting a drainage hole or line in an entranceway of a building featuring a generally flat base panel; a plurality of pores disposed in the base panel, the pores allow liquid to pass through the base panel while retaining debris; at least one handle disposed on the base panel; one or more adjustable legs extending downwardly form the bottom surface of the base panel, wherein the adjustable legs can be adjusted in height, wherein at least one side edge of the base panel is free of adjustable legs; and a set of reinforcing ribs disposed under the base panel, the reinforcing ribs help provide structural strength to the base for when an individual walks on the drain screen assembly.

8 Claims, 3 Drawing Sheets

FIG. 4

DRAIN SCREEN ASSEMBLY

FIELD OF THE INVENTION

The present invention is directed to filtering systems, more particularly to a drain protector for helping to prevent leaves or other debris from clogging a drain in an entranceway to a home or building.

BACKGROUND OF THE INVENTION

Leaves or other debris can have a tendency collect in entranceways to homes and other buildings. This can cause the drainage holes or lines in the entranceways to clog, putting the entranceways at risk of flooding. The present invention features a drain screen assembly for protecting the drainage holes or lines. The assembly can help prevent flooding or other damage associated with clogged drain holes or lines.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 3:
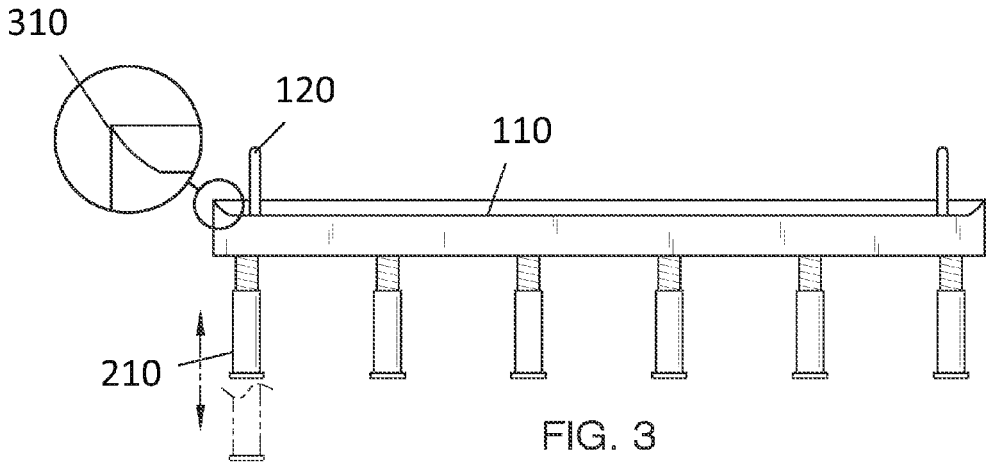
FIG. 3 is a front view of the drain screen assembly of FIG. 1.
Figure 4:
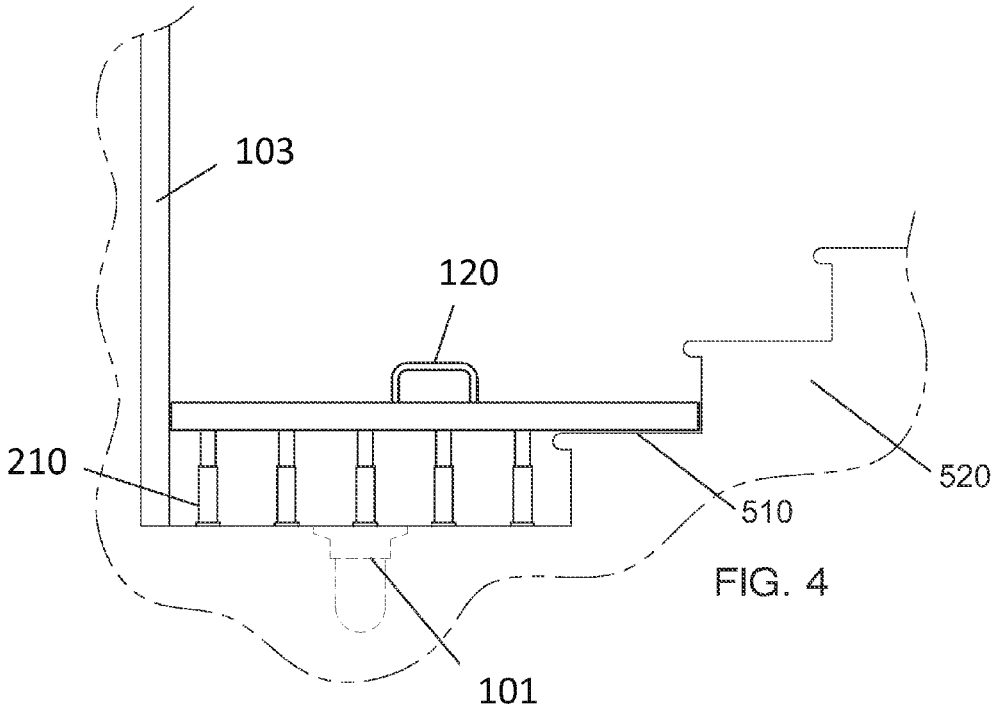
FIG. 4 is an in-use view of the drain screen assembly of FIG. 1.

Referring now to FIGS. 1-5, the present invention features a drain screen assembly 100 for protecting drainage holes 101 or lines in entranceways of homes or buildings (e.g., areas between descending stairs 102 and doors 103, see FIG. 4). The assembly 100 of the present invention can help prevent flooding or other damage associated with clogged drain holes or lines.

The assembly 100 of the present invention comprises a generally flat base panel 110 having a top surface, a bottom surface, a first side edge, a second side edge, a third side edge, and a fourth side edge. Disposed in the base panel 110 is a plurality of pores 150. The pores 150 allow liquid (e.g., water) to pass through the base panel 110 while retaining debris such as leaves. Sieves and other filtering devices with pores are well known to one of ordinary skill in the art.

Figure 1:
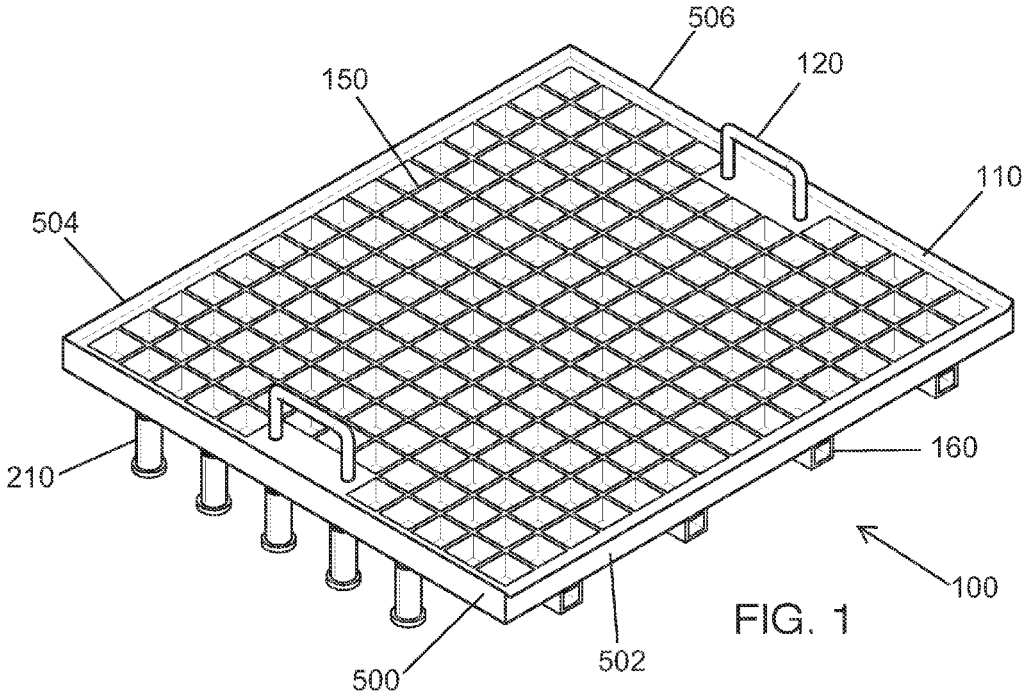
FIG. 1 is a perspective view of the drain screen assembly of the present invention.
Figure 2:
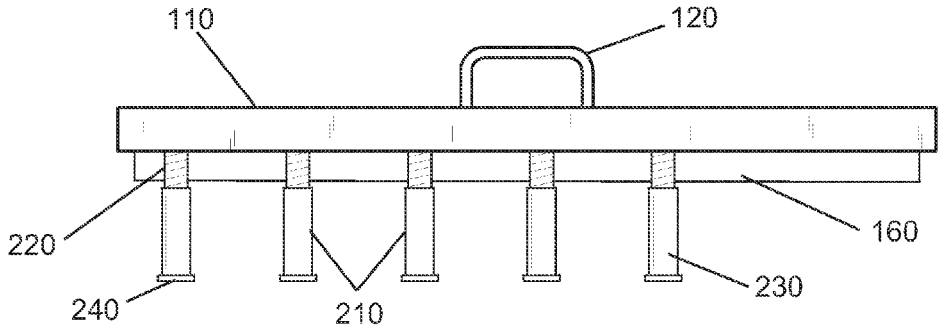
FIG. 2 is a side view of the drain screen assembly of FIG. 1.

The base panel 110 may be constructed in a variety of sizes and shapes and from a variety of materials. As shown in FIG. 1, in some embodiments, the base panel 110 is constructed in a generally rectangular shape. The base panel 110 may alternatively be constructed in a generally circular, oval, triangular, trapezoidal, or other shape. In some embodiments, the base panel 110 is constructed from a material comprising plastic, metal, wood, the like, or a combination thereof.

In some embodiments, the base panel 110 is about 47.5 inches in length as measured from the first side edge to the second side edge. In some embodiments, the base panel 110 is between about 30 to 40 inches in length as measured from the first side edge to the second side edge. In some embodiments, the base panel 110 is between about 40 to 50 inches in length as measured from the first side edge to the second side edge. In some embodiments, the base panel 110 is between about 50 to 60 inches in length. In some embodiments, the base panel 110 is more than about 60 inches in length.

In some embodiments, the base panel 110 is about 43.5 inches in width as measured from the third side edge to the fourth side edge. In some embodiments, the base panel 110 is between about 25 to 35 inches in width as measured from the third side edge to the fourth side edge. In some embodiments, the base panel 110 is between about 35 to 45 inches in width as measured from the third side edge to the fourth side edge. In some embodiments, the base panel 110 is between about 45 to 55 inches in width as measured from the third side edge to the fourth side edge. In some embodiments, the base panel 110 is more than about 55 inches in width.

Disposed on the base panel 110, for example on the top surface, near the first side edge, second side edge, third side edge, and/or fourth side edge, is one or more handles 120. The handles 120 provide a means of lifting and carrying the assembly 100.

Disposed on the base panel 110, for example extending downwardly from the bottom surface of the base panel 110 is one or more adjustable legs 210. The height of the adjustable legs 210 can be adjusted. In some embodiments, the adjustable legs 210 are telescopic legs. In some embodiments, the adjustable legs 210 comprise a threaded shaft 220 attached to the base panel 110 and an outer shaft 230, the outer shaft adapted to receive the threaded shaft 220 in an inner cavity. Threaded shafts are well known to one of ordinary skill in the art. The present invention is not limited to telescopic legs or threaded shafts for adjustment purposes. In some embodiments, the legs 210 are absent from one of the side edges of the base panel 110. For example, in some embodiments, the legs 210 are positioned only near the first side edge 500, the second side edge 502, and a third side edge 504 of the base panel 110. This allows the other edge 506 (with no legs) to be rested on a step 510 of a stair case 520 (see FIG. 2 and FIG. 4).

In some embodiments, a footing 240 (or grip component) is disposed on the ends of the adjustable legs 210 for helping provide stability to the adjustable legs 210. Footings and grip components are well known to one or ordinary skill in the art. Height of the base 110, via the adjustable legs 210, can vary, for example the base 110 may be between about 4 to 10 inches in height. In some embodiments, the height is more than about 10 inches.

As shown in FIG. 3, in some embodiments, side walls 310 are disposed on the top surface of the base panel 110. Or, in some embodiment, the top surface of the base panel 110 is sloped (curved downwardly), for example an indentation is disposed in the top surface of the base panel 110, the indentation being with respect to the side edges of the base panel 110. The side walls 310 or indentation in the top surface of the base panel 110 may help to sequester debris, while still allowing fluid (e.g., water) to seep through past the base panel 110.

In some embodiments, a set of reinforcing ribs 160 is disposed under the base panel 110. The reinforcing ribs may help to give the base 110 sufficient structural strength, for example strength to support an individual walking, across the assembly 100 (e.g., after the legs are installed and the assembly 100 is raised above the level of the entranceway).

In some embodiments, one or more edges of the base panel 110 comprise a rubber covering.

Figure 5:
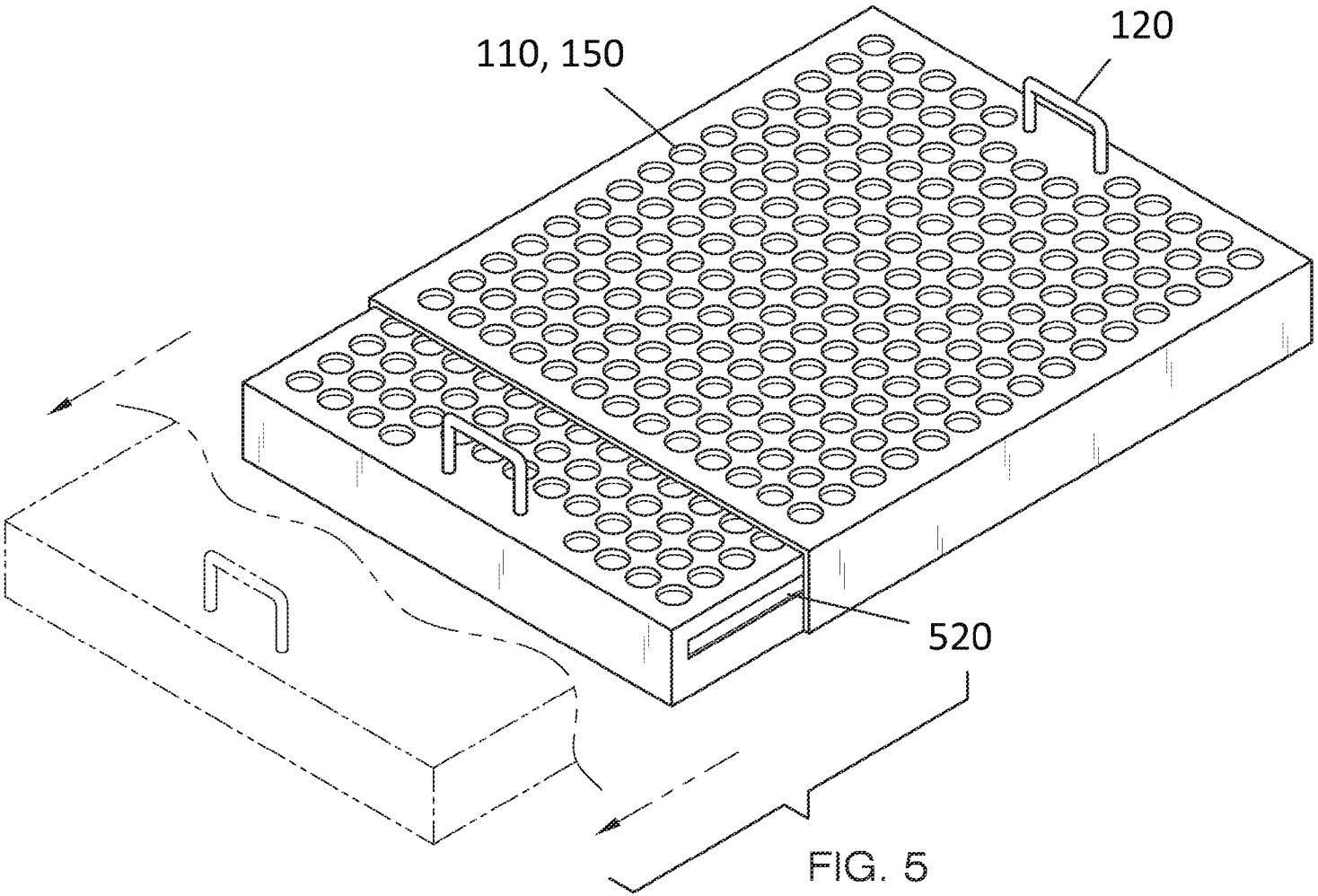
FIG. 5 is a perspective view of an alternative embodiment of the drain screen assembly of the present invention.

As shown in FIG. 5, in some embodiments, the base panel 110 is constructed as two pieces, an inner piece being telescopically received in an outer piece. In some embodiments, the inner piece can slide in and out of the outer piece via a sliding mechanism (e.g., rails 520). The telescopic pieces of the base 110 allow the size of the assembly 100 to be easily adjusted, which provides versatility. The two-piece base 110 may be constructed in a variety of sizes. For example, in some embodiments, the two-piece base 110 can be between about 40 to 80 inches in length. In some embodiments, the width is between about 35 to 90 inches. The present invention is not limited to the aforementioned dimensions.

The following the disclosures of the following U.S. Patents are incorporated in their entirety by reference herein: U.S. Pat. No. 5,130,016; U.S. Pat. No. 4,301,557; U.S. Pat. No. 5,744,048; U.S. Pat. No. 4,367,142; U.S. Pat. No. 7,066,111.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A drain screen assembly for protecting a drainage hole or line in an entranceway of a building, said drain screen assembly comprising:

(a) a stair case having a step;

(b) a generally flat base panel having a top surface, a bottom surface, a first side edge, a second side edge, a third side edge, and a fourth side edge, wherein an indentation is disposed in the top surface of the base panel;

(c) a plurality of pores disposed in the base panel, the pores allow liquid to pass through the base panel while retaining debris;

(d) least one handle disposed on the base panel;

(e) one or more adjustable legs extending downwardly form the bottom surface of the base panel, wherein the adjustable legs can be adjusted in height, wherein at least one side edge of the base panel is free of adjustable legs, wherein the legs are positioned only at the first edge the second edge and the third edge of the base panel and not at the fourth edge, thus allowing the fourth edge to rest on the step; and (f) a set of reinforcing ribs disposed under the base panel, the reinforcing ribs help provide structural strength to the base for when an individual walks on the drain screen assembly.

2. The drain screen assembly of claim 1, wherein the base panel is constructed from a material comprising plastic, metal, wood, or a combination thereof.

3. The drain screen assembly of claim 1, wherein the base panel is between about 30 to 60 inches in length as measured from the first side edge to the second side edge.

4. The drain screen assembly of claim 1, wherein the base panel is between about 25 to 55 inches in width as measured from the third side edge to the fourth side edge.

5. The drain screen assembly of claim 1 further comprising a rubber covering disposed one or more side edges of the base panel.

6. The drain screen assembly of claim 1, wherein the adjustable legs are telescopic legs.

7. The drain screen assembly of claim 1 further comprising footings disposed on the adjustable legs for helping provide stability to the adjustable legs.

8. The drain screen assembly of claim 1, wherein the base panel is constructed as two pieces including an inner piece telescopically received in an outer piece, wherein the inner piece can slide in and out of the outer piece via a sliding mechanism.

* * * * *